US005536209A

United States Patent [19]

Suzuki

[11] Patent Number: 5,536,209

[45] Date of Patent: Jul. 16, 1996

[54] CUTTING-MAGIC DEVICE

[75] Inventor: Tooru Suzuki, Tokyo, Japan

[73] Assignee: Tenyo Co., Ltd., Tokyo, Japan

[21] Appl. No.: 506,643

[22] Filed: Jul. 25, 1995

[30] Foreign Application Priority Data

Jul. 25, 1994 [JP] Japan ..... 6-172196

[51] Int. Cl.[6] ..... A63J 21/00

[52] U.S. Cl. ..... 472/69; 472/71; 446/219

[58] Field of Search ..... 472/51, 54, 55, 472/69, 71, 63; 446/219

[56] References Cited

U.S. PATENT DOCUMENTS 5,449,324 9/1995 Sugawara ..... 472/69

*Primary Examiner*—Kenneth J. Dorner
*Assistant Examiner*—Kien T. Nguyen
*Attorney, Agent, or Firm*—Sixbey, Friedman, Leedom & Ferguson; Gerald J. Ferguson, Jr.

[57] ABSTRACT

A cutting-magic device is disclosed which comprises a case open at the top there of and hang a bottom and a circumferential wall, and a partition which parts the case into a first half and a second half. The case has formed in the bottom of the first half thereof an opening through which a pencil, finger or any other bar-like article is to be inserted. The partition has a mirror provided on the side thereof facing the second half of the case. The partition has mounted thereon a tubular member which can be slid up and down along the partition. The case has mimic scissors provided thereon. A pencil, finger or any other bar-like article inserted from the opening in the case and penetrated through the tubular member appears, under the reflection effect of the mirror, as if it were cut by the mimic scissors.

4 Claims, 8 Drawing Sheets

CUTTING-MAGIC DEVICE

The present invention relates to a magic device which can provide an illusion that a pencil, finger or any other bar-like article is cut by mimic scissors.

SUMMARY OF THE PRESENT INVENTION

The present invention has an object to provide a cutting-magic device simply constructed and very easy to use.

The above object is attained by providing a cutting-magic device comprising, according to the present invention, a case open at the top thereof and composed of a bottom wall and a circumferential wall; a partition provided as erected vertically on the bottom of the case to part the case to a first half and a second half; a mirror provided on the side of the partition facing the second half of the case; a tubular member provided as fitted on the partition and movable vertically along the partition; and mimic scissors composed of a blade provided beneath the tubular member and extending horizontally in the second half of the case, a first handle contiguous to the blade and disposed outside the case as pivoted to a portion of the outer circumference of the case to turn the blade horizontally, and a second handle also disposed outside the case and pivoted to the outer circumferential potion to which the first handle is also pivoted. The case has an opening formed in the bottom of the first half thereof. Thus, a pencil, finger or any other bar-like article can be inserted through this opening and tubular member from outside the bottom of the case. The blade of the mimic scissors is located beneath the tubular member and faces the mirror, so the blade appears as if it were a pair of blades, owing to the reflection by the mirror.

The cutting-magic device according to the present invention is to be used as follows:

A pencil, finger or any other bar-like article is inserted from outside the bottom of the case through the opening in the case bottom and the tubular member. For the simplicity of the explanation, it is assumed here that a player with the device uses a pencil. The player holds the device in such a manner that the end portion of the pencil projecting from inside the top portion of the tubular member is seen obliquely from above by the audience. At this time, the audience sees the upper and lower end portions of the pencil projecting from the top of the tubular member as well as from the bottom of the case, respectively. However, the intermediate portion of the pencil is not visible to the audience because it stays in the tubular member and behind the partition or mirror. The case bottom at the first half is little seen to the audience since it is hidden behind the partition or mirror. The mirror reflects the inner walls of the second half of the case to give the audience an illusion that the first and second halves of the case are contiguous directly to each other, not parted by the partition.

For playing a cutting magic with the device according to the present invention, the player holds the device in one of the hands. Before inserting a pencil into the opening in the case bottom and through the tubular member, the player lowers the tubular member to a position where the bottom end thereof nearly touches the blade of the mimic scissors, and opens out the scissors blade by applying the fingers of the other hand to the scissors handles. Because of the reflection by the mirror, the audience will be given an illusion that a pair of scissors blades is opened. In this condition, the player takes a pencil, for example, and inserts it from outside the case bottom into the opening and then through the tubular member. Then the player operates the scissors handles with the fingers to close the scissors blade. The audience will be given an illusion that the scissors blades is about to cut the pencil. The player closes the scissors blade to a position where it is in contact with the mirror. The player slides up the tubular member to an appropriate extent and moves up the pencil correspondingly to the sliding of the tubular member. The audience will see only the pair of closed scissors blades between the bottom end of the tubular member and case bottom, whereby the audience will be given an illusion that the pencil has been cut by the scissors.

How the foregoing and other more specific objects of the present invention are achieved will appear in the ensuing more detailed description of an illustrative embodiment of the invention which will now be set forth in reference to the drawings.

DETAILED DESCRIPTION OF THE PREFERRED EMBODIMENT

Figure 1:
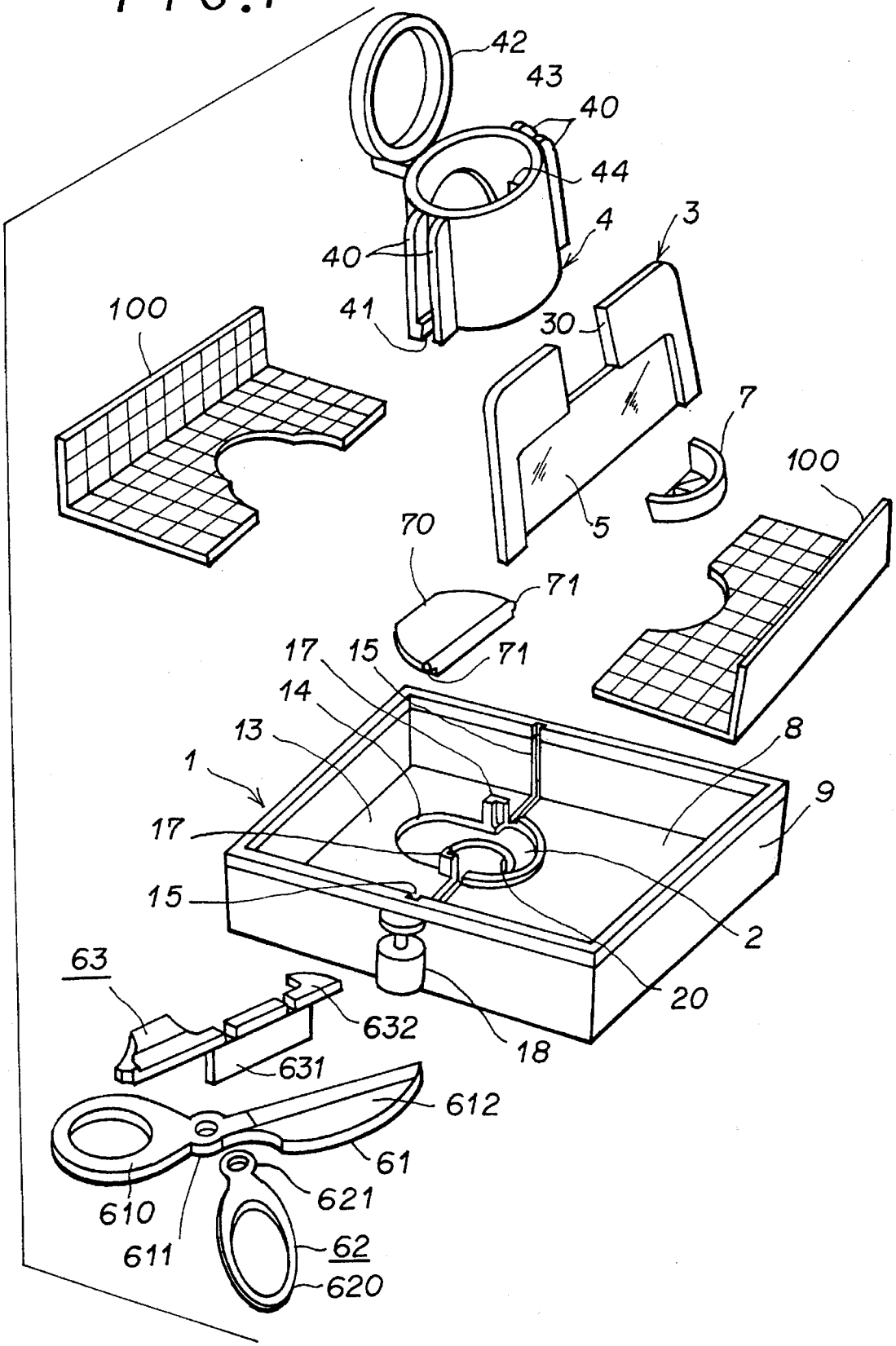
FIG. 1 is an exploded perspective view of an embodiment of the cutting magic device according to the present invention.

Referring now to Figures, the cutting-magic device comprises a case 1 having the shape of a rectangular parallelepiped open at the top thereof and composed of a bottom wall 8 and a circumferential wall 9. The case 1 has provided vertically on a center line H—H thereof extending in parallel with the short sides thereof a partition 3 of which the lower edge is secured as fitted in a recess 15 formed in the case 1 along the center line H—H. Thus, the inner half of the case 1 is parted by the partition 3 into a first half 101 and a second half 102.

Figure 4:
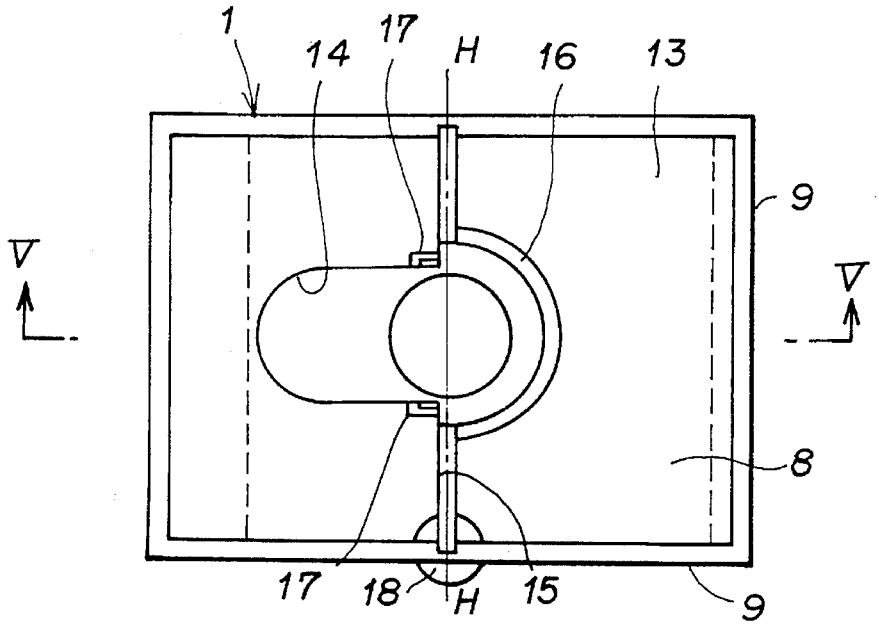
FIG. 4 is a plan view of the case alone.
Figure 5:
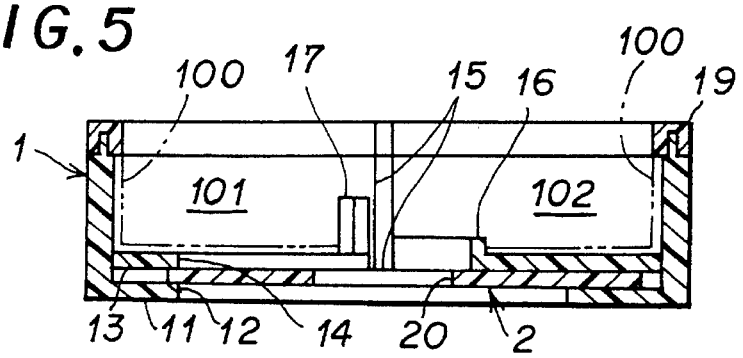
FIG. 5 is a sectional view taken along the line V—V in FIG. 4.
Figure 6:
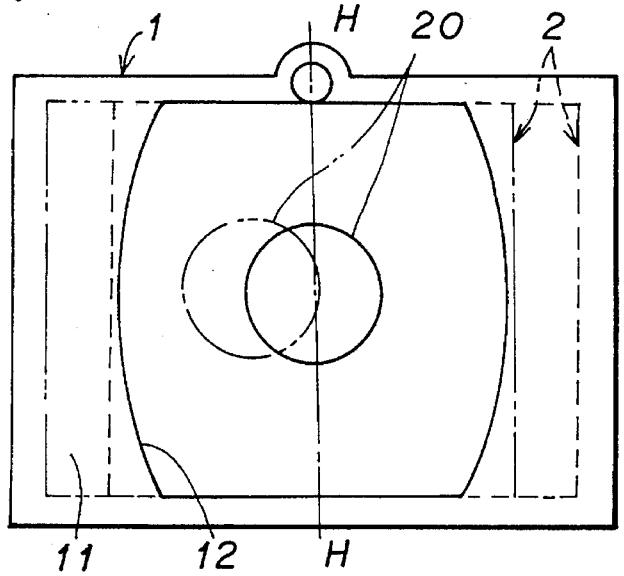
FIG. 6 is a bottom view of the case.

The bottom wall 8 of the case 1 has a double structure: lower bottom wall 11 and upper bottom wall 13. The lower bottom wall 11 has an opening 12 formed therein as shown in FIGS. 5 and 6 (this opening will be called "lower opening" hereafter for the convenience of the explanation), while the upper bottom wall 13 has an opening 14 formed therein as shown in FIGS. 4 and 5 (this opening will be called "upper opening" hereafter). As seen from FIG. 4, the upper opening 14 communicates with the lower opening 12. The upper opening 14 consists of a semi-elliptic portion located at the first half 101 of the case 1 and a semi-circular portion located at the second half 102. A half tubular member 7 is fixed at the edge of the upper opening 14 at the second half 102 to cover the semi-circular portion of the upper opening 14.

Figure 7:
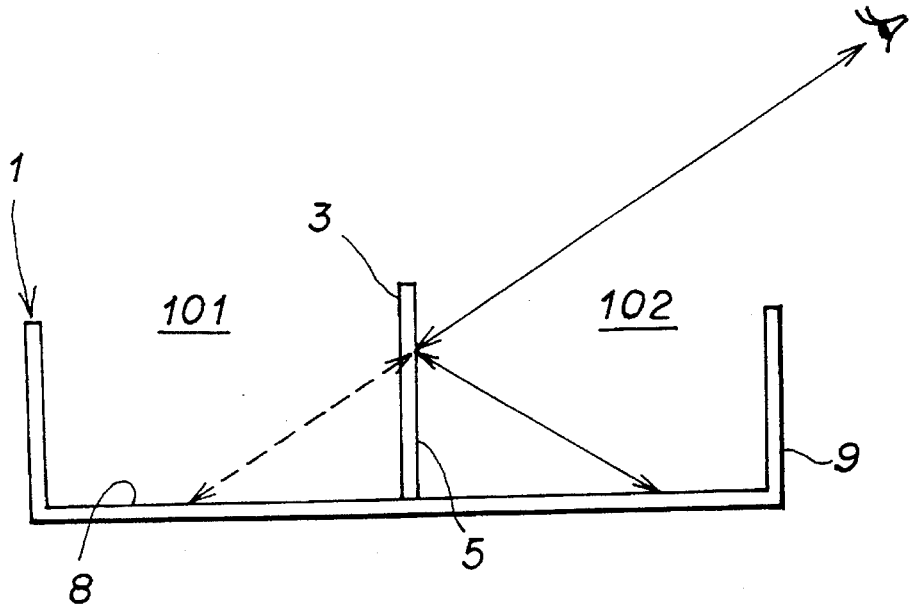
FIG. 7 is an explanatory drawing showing the reflecting principle of the mirror.

There is provided a mirror 5 on the side of the partition 3 facing the second half 102. As shown in FIG. 7, when looking into the second half 102 of the case 1 obliquely from above, one will given, due to the reflection by the mirror 5, an illusion that the inner wall and bottom surface of the second half 102 are contiguous to those of the first half 101. Namely, one will be given an illusion that the partition 3 is lack of a portion thereof corresponding to the mirror 5, and thus the first and second halves will appear as if they were not parted by the partition 3.

Also, owing to the reflection by the mirror 5, the real vision and reflected image of the above-mentioned semi-tubular member 7 will effectively provide an illusion that there exists on the bottom of the case I a tube open at the top thereof and closed at the bottom thereof.

The mirror 5 is made of a flexible sheet having aluminum evaporated thereon and which is attached to the partition 3. It may be made by evaporating aluminum directly onto the partition 3.

The partition 3 has mounted thereon the tubular member 4 made of a synthetic resin having an appropriate resilience, in such a manner that the diametrical direction of the tubular member 4 coincides with the axis of the partition 3. Also, the tubular member 4 is so fitted on the partition 3 as to be movable up and down along the partition 3. More particularly, there is provided at either of generally diametrical positions on the outer circumference of the tubular member 4 a pair of guide members each consisting of two guide and hold pieces 40 directed axially of the tubular member 4. The two guide and hold pieces 40 of each guide member hold resiliently between them either of the right and left edges of a cut 30 formed in the upper central portion of the partition 3. Of the four guide and hold pieces 40, two at the first half 101 have a guide pawl 41 formed at the lower end thereof. The partition 3 has two guide recesses 31 formed vertically on the surface thereof at the first half 101. The guide pawls 41 are engaged in the guide recesses 31, respectively. Thus, by applying the tubular member 4 with an appropriate force in a vertical direction, the tubular member 4 can be slid vertically along the partition 3.

At the first half 101, the tubular member 4 is cut out, as indicated with a reference numeral 43, at the circumference thereof obliquely from an upper portion down thereof toward the bottom center thereof. The cut 43 is provided to facilitate to insert a pencil P into the tubular member 4 through the lower and upper openings 12 and 14 from outside the case bottom. A member (not illustrated) may be provided as pivoted on the tubular member 4 to cover the cut 43 of the tubular member 4.

The tubular member 4 has a slit 44 formed generally axially therein between the guide and hold pieces 40 in each pair formed thereon. The slit 44 extends over a predetermined length from the lower end of the tubular member 4. The slit 44 has a width somewhat larger than the thickness of the partition 3. The downward sliding of the tubular member 4 along the partition 3 is limited by the upper ends of the slits 44.

The case 1 has provided thereon mimic scissors 6 composed of a first scissors member 61 including a first handle 610, a blade 612 extending contiguously to the handle 610 and a pivot 611 located between the first handle 610 and the blade 612, a second scissors member 62 including a second handle 620 and a pivot 621, and a third scissors member 63 consisting of a blade 632.

The first and second scissors members 61 and 62 are fitted pivotably at their respective pivots 611 and 612 to a bearing boss 18 provided on the outer circumference of the case 1. The first handle 610 of the first scissors member 61 and the second handle 620 of the second scissors member 62 are located outside the case 1. The blade 612 of the first scissors member 61 is located under the tubular member 4 at the second half 102. Thus, when viewed obliquely from above at the second half 102, the blade 612 appears, due to the reflection by the mirror 5, as if it were a pair of blades.

The third scissors member 63 is fixed to the side of the partition 3 facing the first half 101.

A lid 42 is provided openably at the upper opening edge of the tubular member 4.

An ornamental sheet 100 is provided in each of the first and second halves 101 and 102 of the case 1. The ornamental sheet 100 is made of a cardboard or the like having a pattern of checks, for example, marked on the surface thereof. Note that the ornamental sheet 100 is not shown in all Figures.

There is provided between the upper bottom wall 13 and lower bottom wall 11 of the case 1 a sliding sheet 2 which is slidable longitudinally of the case 1, namely, in a direction perpendicular to the partition 3, from a first position to a second position or vice versa. The sliding sheet 2 has a circular opening 20 (will be called "middle opening" hereafter) formed in the center thereof. When the sliding sheet 2 is located in the first position (indicated with a dashed line in FIG. 6), the middle opening 20 is positioned in the center (on the center line H—H) of the case i as indicated with a solid line in FIG. 6. When the sliding sheet 2 is located in the second position (indicated with a two-dot chain line in FIG. 6), the middle opening 20 takes a position a little to the first half 101 from the center line H—H of the case i as indicated with the two-dot chain line in FIG. 6 and where the middle opening 20 communicates with the upper and lower openings 14 and 12.

Further, a bottom lid 70 is provided as openably installed to the side of the upper bottom wall 13 of the case 1 facing the first half 101. The bottom lid 70 has pins 71 formed integrally at opposite ends thereof. The pins 17 are received between bearings 17 and a fitting plate 631 provided on the third scissors member 63, so that the bottom lid 70 can be flipped up about the pins 17 when a pencil P is inserted through the middle opening 20, lower and upper openings 12 and 14 from outside the case bottom. The bottom lid 70 is provided to close a part of the upper opening 14 (semi-circular portion of the opening 20 when the sliding sheet 2 is placed in the first position). Thus, when the sliding sheet 2 is located in the first position and the bottom lid 70 is in the closed position, the middle opening 20 in the sliding sheet 2 is dosed with the half tubular member 7 and bottom lid 70. So, even if the bottom surface of the case 1 is directed toward the audience's eyes, the existence of the upper opening 14 in the case 1 will not be noticeable to the audience.

Figure 8:
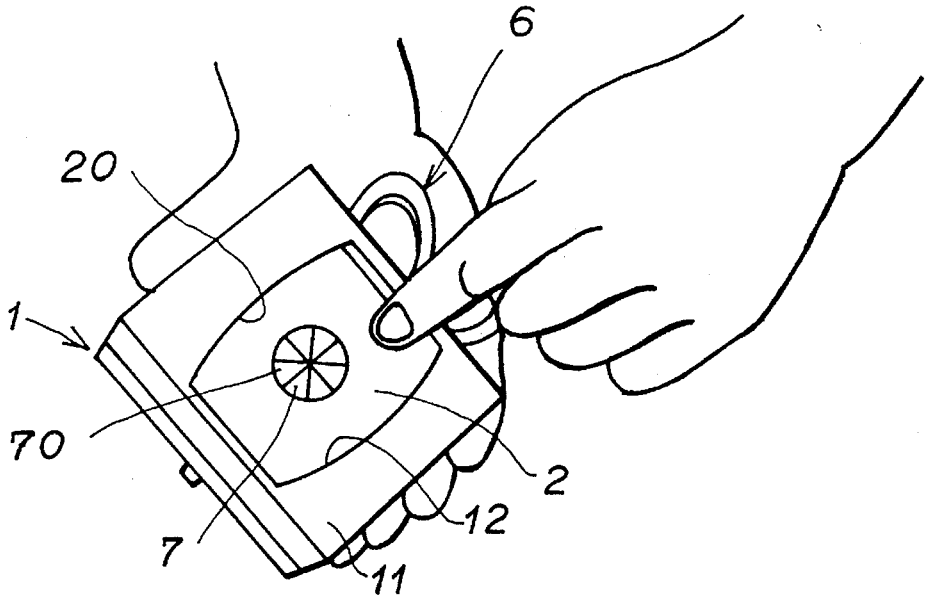
FIG. 8 is an explanatory drawing showing the lower side of the lower bottom wall of the case directed toward the audience's eyes.

As shown in FIGS. 1 and 8, radial recesses are formed in both sides of the semi-tubular member 7 and the lower side of the bottom lid 70. The portion having the radial recesses will look like a gate through which a pencil P is to be inserted. Thus, when the bottom of the case 1 is shown to the audience, an illusion can be given to the audience that a circular opening with such a gate is provided in the bottom center of the case 1, corresponding to the tubular member 4.

Figure 2:
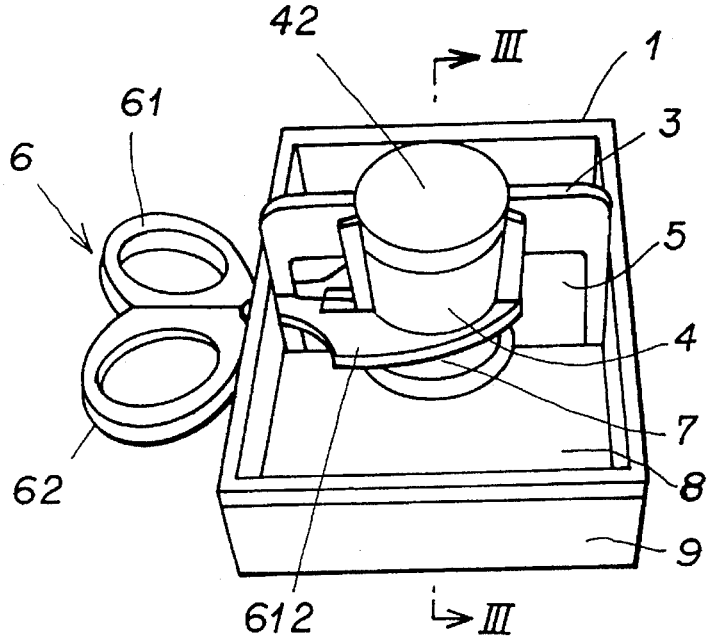
FIG. 2 is a perspective view of the device from the audience.
Figure 3:
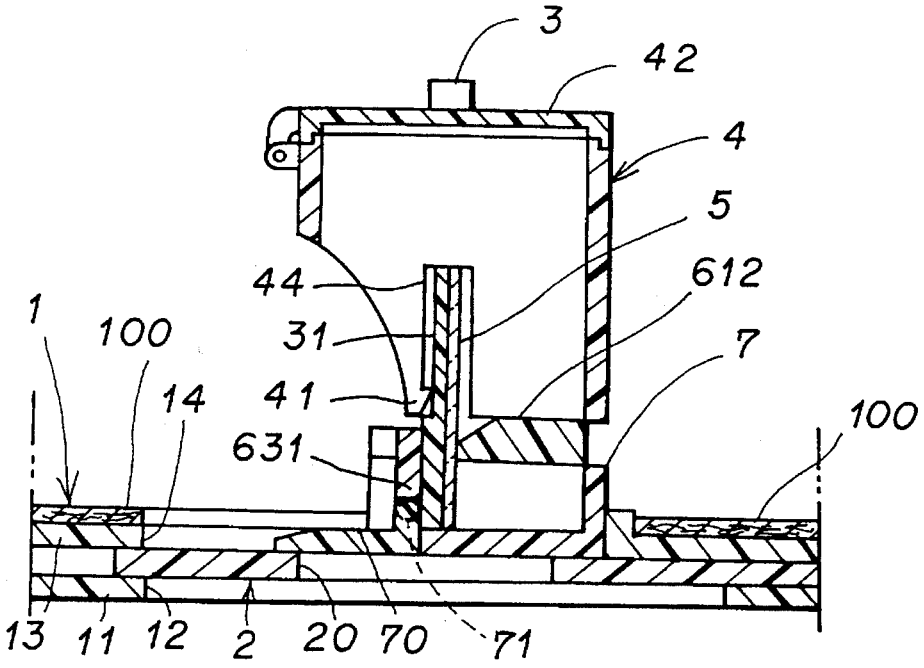
FIG. 3 is a sectional view taken along the line III—III in FIG. 2.

The cutting-magic device according to the present invention has a construction having been described in the foregoing. How to play the device will be discussed herebelow:

Preparation:

First, the player lowers the tubular member 4 along the partition 3 to the lowest position, closes the lid 42 of the tubular member 4, closes the mimic scissors and places the sliding sheet 2 in the first position (see FIGS. 2 and 3).

Play

First, the player holds the case I in the hand and shows it to the audience. At this time, the player should hold the device as directed so that the audience will see it obliquely from above, to thereby prevent the audience from being aware of the existence of the mirror 5.

Next, the player presses the bottom lid 70 from inside the case i and shows the bottom of the case 1 to the audience. This performance is intended to have the audience confirm that the lower opening 12 in the lower bottom wall 11 is closed with the sliding sheet 2 and the middle opening 20 in the case 1 is closed with the bottom of the semi-tubular member 7 and the bottom lid 70 (as shown in FIG. 8).

Figure 9:
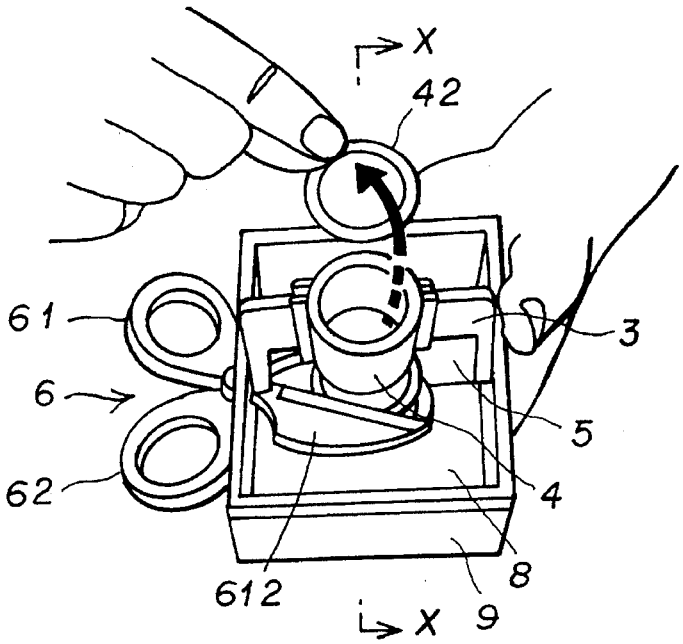
FIG. 9 is an explanatory drawing showing the tubular member moved up, the mimic scissors opened, the sliding plate slid from a first position to a second position, the lid of the tubular member opened and the case bottom lid opened.
Figure 10:
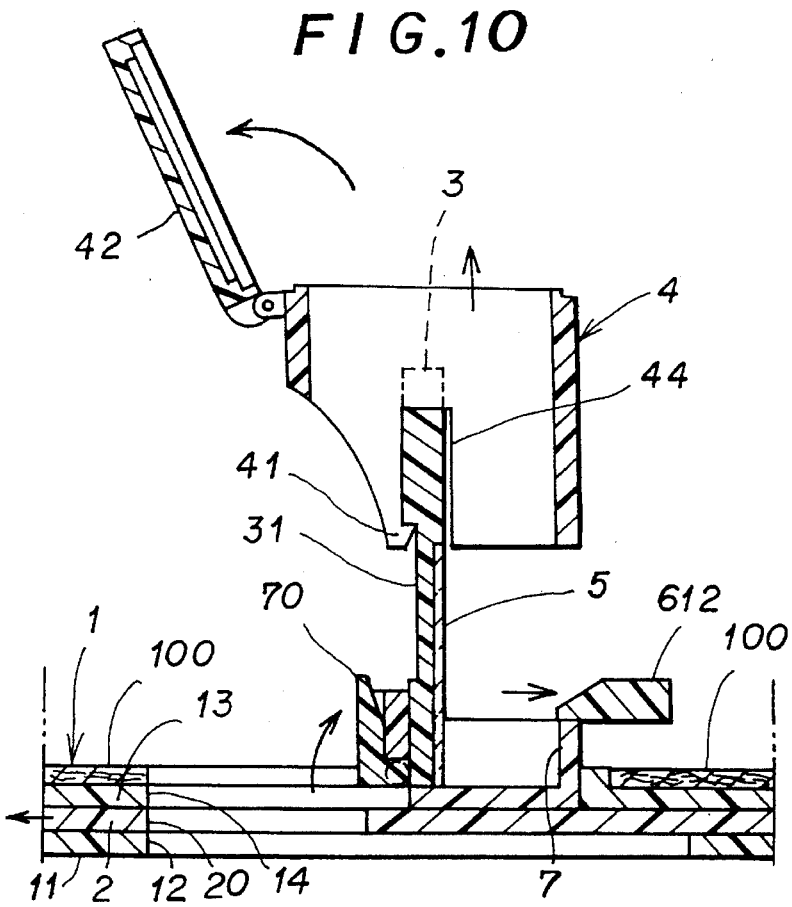
FIG. 10 is a sectional view taken along the line X—X in FIG. 9.

Then, the player lifts up the tubular member 4, opens the mimic scissors 6, slides the sliding sheet 2 from the first to second position, opens the lid 42 of the tubular member 4, and flips the bottom lid 70 by pressing with a finger (as shown in FIGS. 9 and 10).

Figure 11:
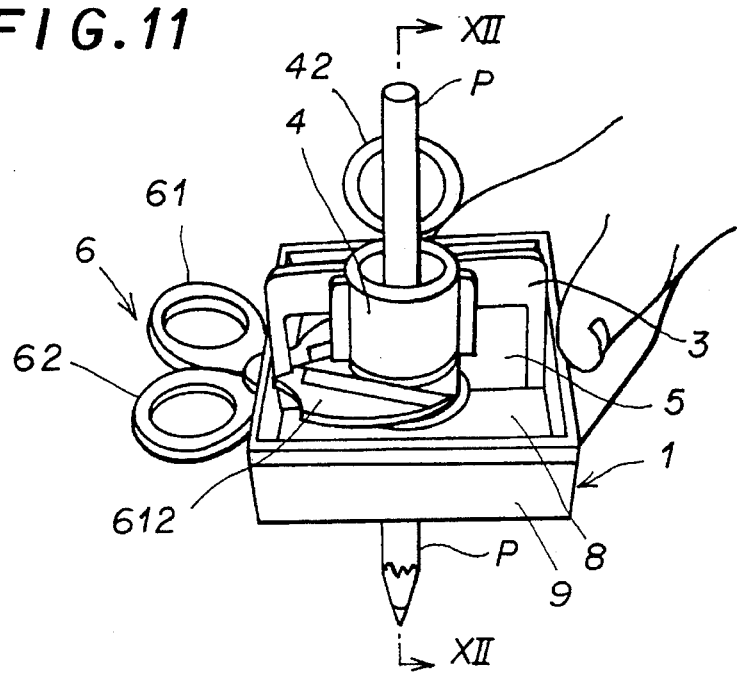
FIG. 11 is an explanatory drawing showing a pencil inserted through the tubular member and the opening in the bottom of the first half of the case.
Figure 12:
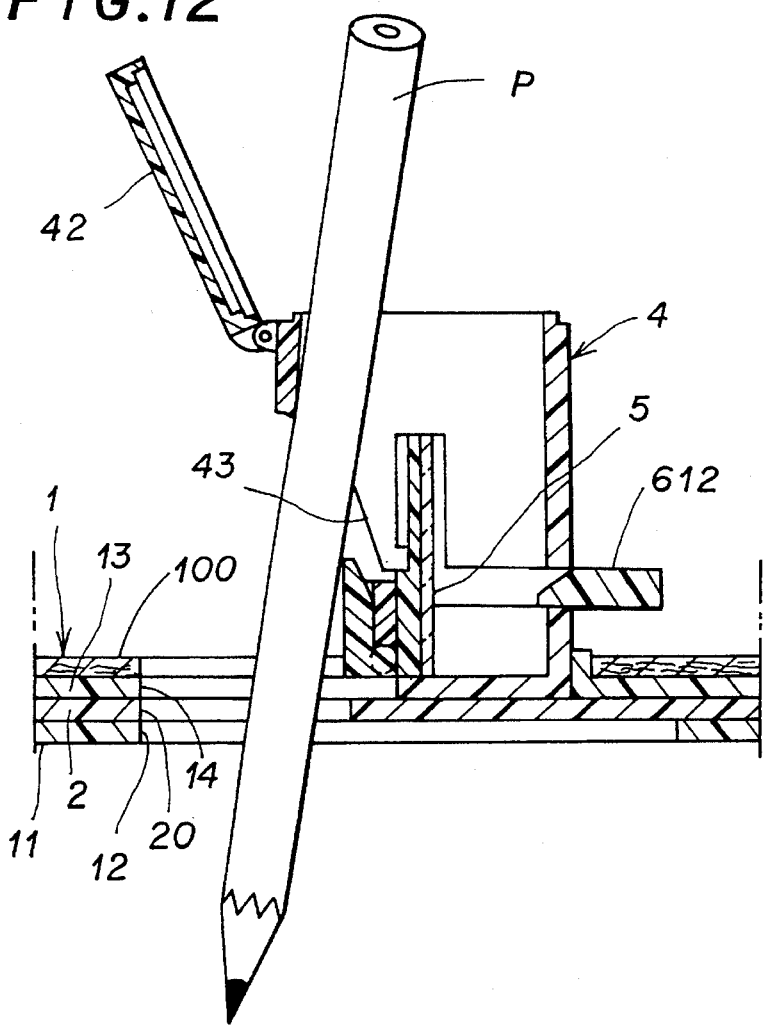
FIG. 12 is a sectional view taken along the line XII—XII.

After that, the player lowers the tubular member 4 once, and inserts a pencil P, for example, from the rear side of the case 1 into the lower opening 12, middle opening 20, upper opening 14 and then into the tubular member 4. At this time, both ends of the pencil P should be projected from the top of the tubular member 4 and bottom of the case 1, respectively (as shown in FIGS. 11 and 12).

The player closes the mimic scissors 6, lifts up again the tubular member 4, and moves up the pencil P for the lift of the tubular member 4. Thus, the cutting by the scissors 6 of the pencil P penetrated through the tubular member 4 is shown to the audience.

Figure 13:
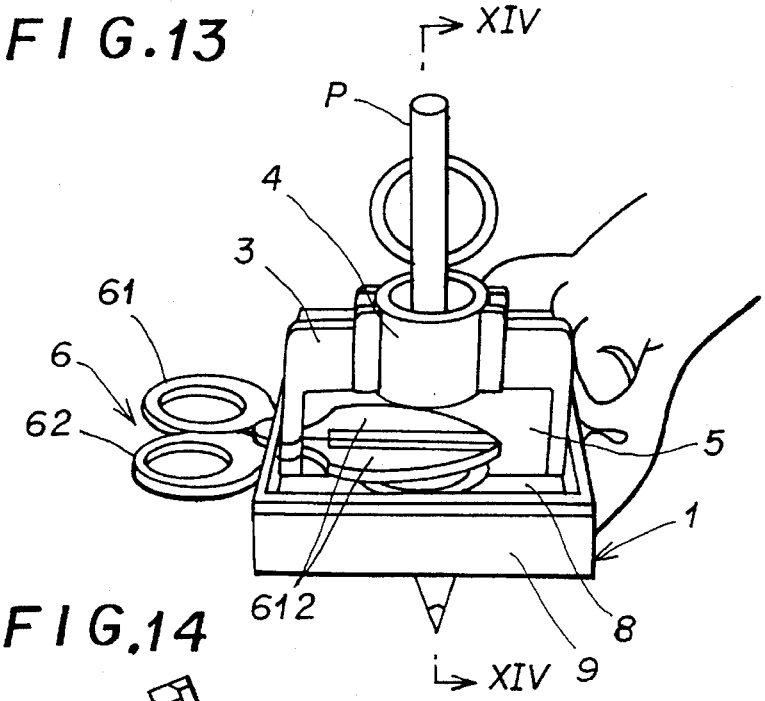
FIG. 13 is an explanatory drawing showing the mimic scissors closed and the tubular member moved up.
Figure 14:
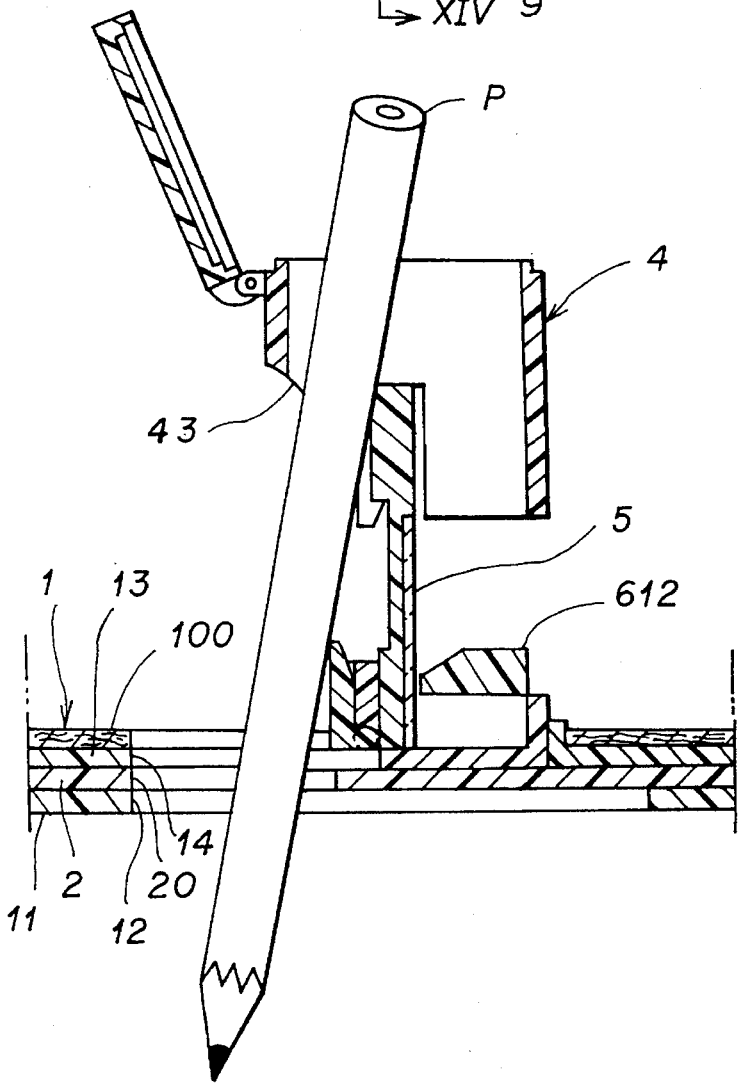
FIG. 14 is a sectional view taken along the line XIV—XIV in FIG. 13.

At this time, the intermediate portion of the pencil P is hidden behind the partition 4 and so not visible to the audience but the mirror 5 shows a pair of the scissors blades 612 to the audience. Owing to the reflection by the mirror 5, the audience will not be aware of the existence of the mirror 5 itself. Therefore, the audience will be given an illusion that the pencil P has been cut by the mimic scissors 6 (as shown in FIGS. 13 and 14).

Figure 15:
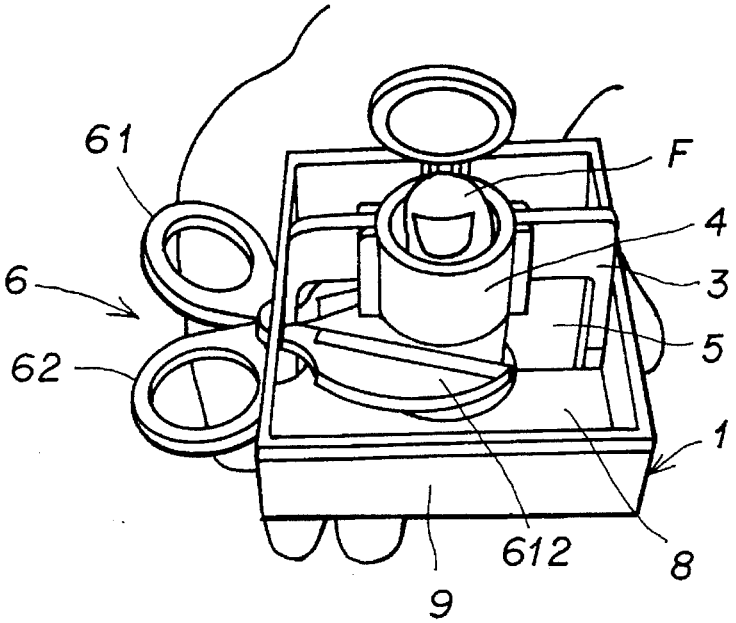
FIG. 15 is an explanatory drawing showing the player's finger inserted through the tubular member.
Figure 16:
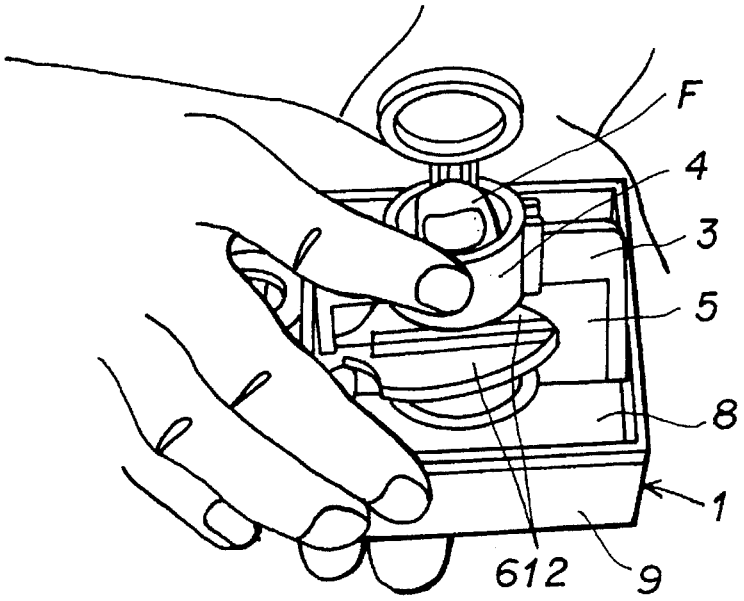
FIG. 16 is an explanatory drawing showing an illusion that the finger has been cut by the mimic scissors.

Note that the player may use the finger F or any other bar-like article instead of the pencil P (as shown in FIGS. 15 and 16).

According to the aforementioned embodiment, there are disposed around the mirror 5 the ornamental sheets 100 in the case 1, partition 3, tubular member 4 and half tubular member 7 to camouflage the existence of the mirror 5 and also the hiding of a pencil P, finger F or any other bar-like article behind the partition 3.

Note that unless otherwise specified, each component of the device according to the aforementioned embodiment is made of an opaque material.

What is claimed is:

1. A cutting-magic device adapted to give an illusion that a pencil, finger or any other bar-like article is cut by mimic scissors, comprising:

a case open at the top thereof and composed of a bottom wall and a circumferential wall;

a partition provided as erected vertically on the case bottom to part the case to a first half and a second half;

a mirror provided on the side of the partition facing the second half of the case;

a tubular member provided as fitted on the partition and movable vertically along the partition; and mimic scissors composed of a blade provided beneath the tubular member and extending horizontally in the second half of the case, a first handle contiguous to the blade and disposed outside the case as pivoted to a portion of the outer circumference of the case to turn the blade horizontally, and a second handle also disposed outside the case and pivoted to the outer circumferential portion to which the first handle is also pivoted, the blade of the mimic scissors appearing, owing to the reflection by the mirror, as if it were a pair of blades;

the case having formed in the bottom of the first half thereof an opening from which the pencil, finger or any other bar-like article can be inserted through the tubular member.

2. A cutting-magic device as set forth in claim 1, wherein the tubular member has provided at the upper opening edge thereof an openable lid which covers the top of the tubular member.

3. A cutting-magic device as set forth in claim 1, wherein the case has ornamental sheets attached on the inner walls and bottom thereof.

4. A cutting-magic device as set forth in claim 1, wherein the case has an upper bottom wall in which an upper opening is formed and a lower bottom wall in which there is also formed a lower opening which communicates with the opening in the upper bottom wall, there being provided slidably between the upper and lower bottom walls a sliding sheet which can be moved generally horizontally between a first position and a second position, the sliding sheet having formed therein a middle opening which is positioned nearly in the center of the case when the sliding sheet is located in the first position, and communicates with the upper and lower openings when the sliding sheet is located in the second position.

* * * * *